US006269607B1

(12) United States Patent
Ringlein et al.

(10) Patent No.: US 6,269,607 B1
(45) Date of Patent: Aug. 7, 2001

(54) METHOD OF INSULATION AND FRAMING

(76) Inventors: Harold Ringlein; Alfred C. Ringlein, both of 14 Osgoode Cir., Regina, Saskatchewan (CA), S4V 0C1; James Morgan, 364 Ottawa St., Regina, Saskatchewan (CA), S4R 1N7

( * ) Notice: Subject to any disclaimer, the term of this patent is extended or adjusted under 35 U.S.C. 154(b) by 0 days.

(21) Appl. No.: 09/455,339

(22) Filed: Dec. 6, 1999

(51) Int. Cl.[7] ..... E04B 1/00

(52) U.S. Cl. ..... 52/745.05; 52/741.1; 52/383; 52/745.02; 52/745.19

(58) Field of Search ..... 52/741.1, 745.02, 52/745.05, 742.13, 745.19, 383, 380, 745.1, 220.2, 733.2

(56) References Cited

U.S. PATENT DOCUMENTS 4,114,345 * 9/1978 Nilsen ..... 52/745.02
5,634,315 * 6/1997 Toya ..... 52/741.1
5,755,062 * 5/1998 Slater ..... 52/79.1
6,145,257 * 11/2000 Cappuccio ..... 52/220.2

* cited by examiner

*Primary Examiner*—Christopher T. Kent
*Assistant Examiner*—Jennifer I. Thissell
(74) *Attorney, Agent, or Firm*—G. F. Gallinger

(57) ABSTRACT

A method of construction which produces an air tight structure which is capable of being insulated to high R values. The method comprises the following steps: erecting an inner wall having a footer, a top plate, and spaced upright studs, along an inner edge portion of the supporting structure; covering the exterior side portion of the inner wall with a vapor barrier so that electrical wiring and plumbing may be run within the interior wall without penetrating the vapor barrier; erecting an outer wall having a footer, a top plate, and spaced upright studs along an outer edge portion of the supporting structure parallel to and spaced from the inner wall, said outer wall used to carry an exterior building wall covering after insulation which is positioned between the walls and between the studs of the outer wall; and, erecting a supported structure on top of the top side portion of the walls. The vapor barrier is extended over the top portion of one of the walls so that it may be subsequently tied into the vapor barrier extending along the supported structure.

10 Claims, 1 Drawing Sheet

METHOD OF INSULATION AND FRAMING

FIELD OF THE INVENTION

Figure 1:
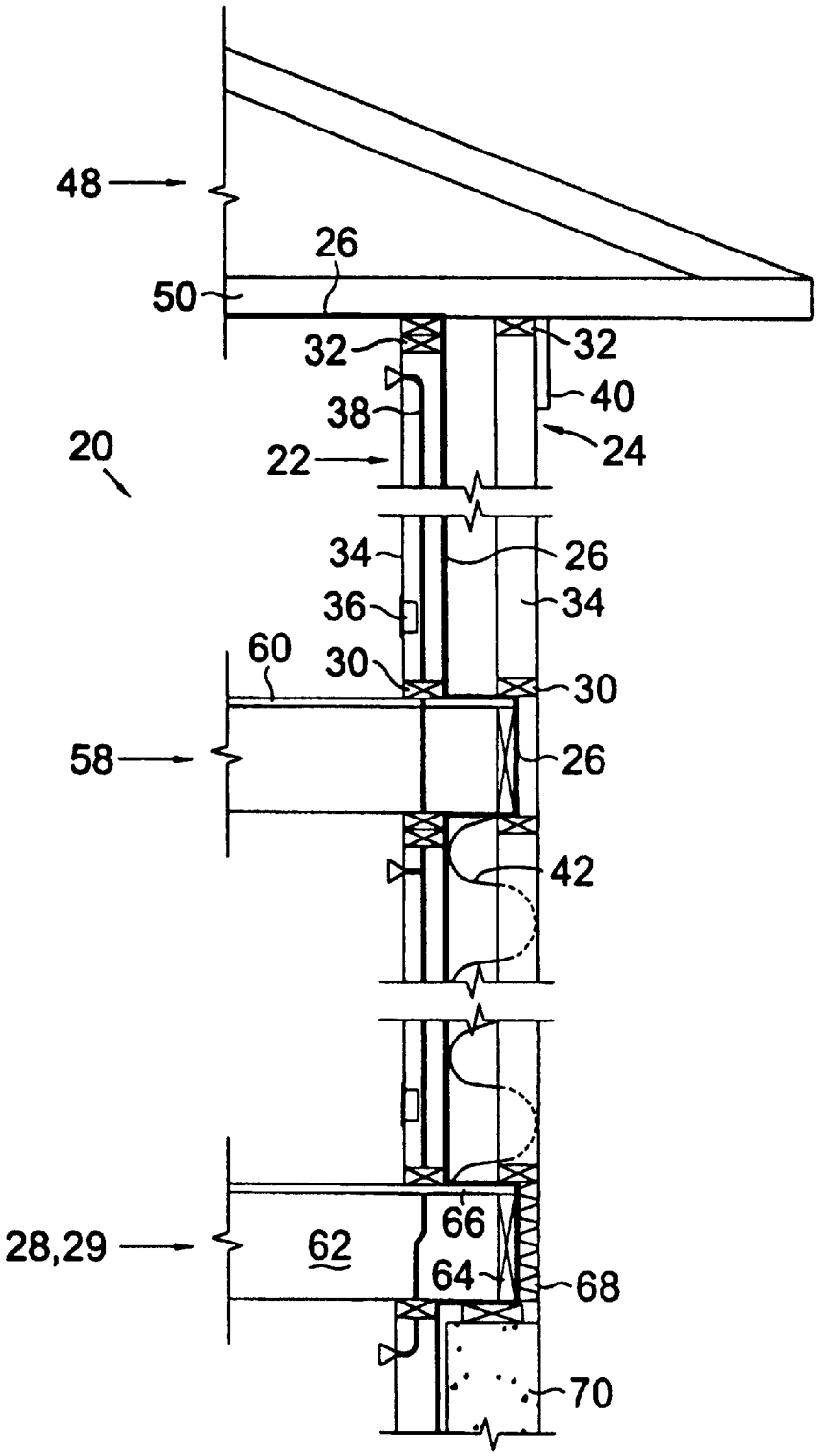

This invention relates to thermally efficient construction. More particularly this invention relates to a method of construction which produces an air tight structure which is capable of being insulated to high R values.

BACKGROUND OF THE INVENTION

Conventional residential construction uses framed exterior walls which comprise a single row of 2×4 or 2×6 studs. The insulation which can be stuffed into the wall is limited by the width of the studs. Above door and window openings headers are required for structural strength and there is no room for insulation. The exterior walls also contain electrical outlet and switch boxes which are interconnected with wire cables. When the wall is covered with an air impervious sheeting it cannot be made air tight because of the openings in its face which must be made for the electrical outlet and switch boxes. Sometimes the exterior wall contains water lines, Because of the inadequate insulation between the walls exterior side and the water lines, freezing of the water lines may be a problem.

As a result of both environmental concerns and reducing heating and cooling costs many individuals have demanded more energy efficient construction methods. The typical house has a total recirculation of air through its exterior a multiple number of times per day. In addition to using more insulation, reducing the total recirculation of air through the closed home is a major focus of concern.

One method of making a house more air tight comprises enclosing the electrical outlet and switch boxes with an air tight shroud. However the problem with this approach is that the shroud must be penetrated by interconnecting electrical cables.

What is needed is a simpler and more effective method of sealing the home. A method which will facilitate better insulation of the house particularly in the critical heat loss areas above doors and windows. And a method which will eliminate exterior air seepage through electrical switch and outlet boxes.

OBJECTS OF THE INVENTION

It is an object of this invention to disclose a method of framing construction which results in a substantially more air tight structure. It is an object of this invention to disclose a method of framing which facilitates more adequately insulating walls. It is an overall objective of this invention to disclose a method of construction which will culminate in a substantially more thermally efficient structure which will have substantially reduced heating and cooling costs. It is yet a further object of this invention to disclose a simple and effective method of framing which uses standard materials in standard and familiar ways. A method which framers will be able to readily adapt to with minimal learning time and with minimal investment in inventory.

One aspect of this invention provides for a method of framing and seating an exterior double wall on a supporting structure comprising the following steps: erecting an inner wall having a footer, a top plate, and spaced upright studs, along an inner edge portion of the supporting structure; covering the exterior side portion of the inner wall with a vapor barrier so that electrical wiring and plumbing may be run within the interior wall without penetrating the vapor barrier; erecting an outer wall having a footer, a top plate, and spaced upright studs along an outer edge portion of the supporting structure parallel to and spaced from the inner wall, said outer wall used to carry an exterior building wall covering after insulation which is positioned between the walls and between the studs of the outer wall; and, erecting a supported structure on top of the top side portion of the walls. If that supported structure includes trusses then the vapor barrier is extended over the top portion of the inner wall before the supported structure is erected thereon, so that the vapor barrier may be subsequently tied into a vapor barrier on a lower side portion of the truss. And if the supported structure is an upper platform for an upper floor, then the vapor barrier is extended over the top portion of the outer wall before the upper platform is supported thereon so that the vapor barrier may be subsequently extended around an edge portion of the upper platform and tied into a vapor barrier on an exterior side of an inner wall carried on the upper platform.

Various other objects, advantages and features of this invention will become apparent to those skilled in the art from the following description in conjunction with the accompanying drawings.

FIGURES OF THE INVENTION

FIG. 1 is a perspective view of a cross sectional view of a wall framing system showing the double wall framing method having a continuous unbroken vapor barrier.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a cross sectional view of a wall framing system 20 showing the double wall 22,24 framing method having a continuous unbroken vapor barrier 26. A method of framing and seating an exterior double wall on a supporting structure 28 comprises the following steps: erecting an inner wall 22 having a footer 30, a top plate 32, and spaced upright studs 34, along an inner edge portion of the supporting structure 28; covering the exterior side portion of the inner wall with a vapor barrier 26 so that electrical wiring 36 and plumbing 38 may be run within the interior wall 22 without penetrating the vapor barrier 26; erecting an outer wall 24 having a footer 30, a top plate 32, and spaced upright studs 34 along an outer edge portion of the supporting structure 28 parallel to and spaced from the inner wall 22, said outer wall 24 used to carry an exterior building wall covering 40 after insulation 42 which is positioned between the walls 22,24 and between the studs 34 of the outer wall 24; and, erecting a supported structure 48 on top of the top side portion of the walls 22,24.

If that supported structure 48 includes trusses 50 then the vapor barrier 26 is extended over the top portion of the inner wall 22 before the supported structure 48 is erected thereon, so that the vapor barrier 26 may be subsequently tied into a vapor barrier 26 on a lower side portion of the truss 50. And if the supported structure 48 is an upper platform 58 for an upper floor 60, then the vapor barrier 26 is extended over the top portion of the outer wall 24 before the upper platform 58 is supported thereon so that the vapor barrier 26 may be subsequently extended around an edge portion of the upper platform 58 and tied into a vapor barrier 26 on an exterior side of an inner wall 22 carried on the upper platform 58.

Most preferably the inner wall 22 is a load bearing wall and the top plate 32 on the inner wall 22 comprises a double plate 32 and the supporting structure 28 is a lower platform 29 comprising joists 62, stringers 64, and a floor covering 66, and wherein the exterior side of the outer wall 24 extends beyond the exterior edge portion of the lower platform 29 so that rigid insulation 68 may be positioned adjacent to and along the edge portion of the lower platform 28 and the exterior side portion of that insulation 68 may vertically align with the exterior side portion of the outer wall 24.

When the lower platform 29 is supported by a foundation 70 and wherein a top portion of the foundation 70 is covered with a vapor barrier 26 before the lower platform 29 is erected thereon so that an inner portion of the vapor barrier 26 may be tied to a vapor barrier 26 covering an inner side portion of the foundation 70; and the outer portion of that vapor barrier 26 may be extended around the edge portion of the lower platform 29 and subsequently tied into the vapor barrier 26 covering the exterior side of the inner wall 22 erected thereon.

Most preferably, in all cases the outer wall 24 comprises 2×4's and the studs 34 therein are on 24" centers. The inner load bearing wall 22 comprises 2×6's on 16" centers when the supported structure 48 is an upper platform 58. The inner load bearing wall 22 comprises 2×4's on 16" centers when the supported structure 48 comprises trusses 50.

Generally the vapor barrier 26 comprises a 6 mil plastic which most preferably is polyethylene. Insulation 42 is stuffed between studs 34 in the inner wall 22 after electrical wiring 36 and plumbing 38 is completed. The ratio of wall insulation 42 outside the vapor barrier 26 to the insulation 42 inside the vapor barrier 26 will in almost all cases exceeds the ratio of 2:1.

While the invention has been described with preferred specific embodiments thereof, it will be understood that this description is intended to illustrate and not to limit the scope of the invention, which is defined by the following claims.

I claim:

1. A method of framing and seating an exterior double wall on a supporting structure comprising the following steps:

erecting an inner wall having a footer, a top plate, and spaced upright studs, along an inner edge portion of the supporting structure;

covering the exterior side portion of the inner wall with a vapor barrier so that electrical wiring and plumbing may be run within the interior wall without penetrating the vapor barrier;

erecting an outer wall having a footer, a top plate, and spaced upright studs along an outer edge portion of the supporting structure parallel to and spaced from the inner wall, said outer wall used to carry an exterior building wall covering after insulation which is positioned between the walls and between the studs of the outer wall; and, erecting a supported structure on top of the top side portion of the walls; and if that supported structure includes trusses then the vapor barrier is extended over the top portion of the inner wall before the supported structure is erected thereon, so that the vapor barrier may be subsequently tied into a vapor barrier on a lower side portion of the truss; and if the supported structure is an upper platform for an upper floor, then the vapor barrier is extended over the top portion of the outer wall before the upper platform is supported thereon so that the vapor barrier may be subsequently extended around an edge portion of the upper platform and tied into a vapor barrier on an exterior side of an inner wall carried on the upper platform.

2. A method as in claim 1 wherein the inner wall is a load bearing wall and wherein the top plate on the inner wall comprises a double plate and wherein the supporting structure is a lower platform comprising joists, stringers, and a floor covering, and wherein the exterior side of the outer wall extends beyond the exterior edge portion of the lower platform so that rigid insulation may be positioned adjacent to and along the edge portion of the lower platform and the exterior side portion of that insulation may vertically align with the exterior side portion of the outer wall.

3. A method as in claim 2 wherein the lower platform is supported by a foundation and wherein a top portion of the foundation is covered with a vapor barrier before the lower platform is erected thereon so that an inner portion of the vapor barrier may be tied to a vapor barrier covering an inner side portion of the foundation; and the outer portion of that vapor barrier may be extended around the edge portion of the platform and subsequently tied into the vapor barrier covering the exterior side of the inner wall erected thereon.

4. A method as in claim 1 wherein the outer wall comprises 2×4's and the studs therein are on 24" centers.

5. A method as in claim 1 wherein the inner wall is a load bearing wall and wherein the inner wall comprises 2×6's on 16" centers when the supported structure is an upper platform.

6. A method as in claim 1 wherein the inner wall is a load bearing wall and wherein the inner wall comprises 2×4's on 16" centers wherein the supported structure comprises trusses.

7. A method as in claim 1 wherein the vapor barrier comprises a 6 mil plastic.

8. A method as in claim 7 wherein insulation is stuffed between studs in the inner wall after electrical wiring and plumbing is completed.

9. A method as in claim 8 wherein the ratio of wall insulation outside the vapor barrier to the insulation inside the vapor barrier exceeds the ratio of 2:1.

10. A method of framing and seating an exterior double wall on a supporting structure comprising the following steps:

erecting an inner wall having a footer, a top plate, and spaced upright studs, along an inner edge portion of the supporting structure; and, erecting an outer wall having a footer, a top plate, and spaced upright studs along an outer edge portion of the supporting structure parallel to and spaced from the inner wall, said outer wall used to carry an exterior building wall covering after insulation which is positioned between the walls and between the studs of the outer wall, said outer wall extending outwardly beyond the supporting structure so that rigid insulation may be used to insulate the supporting structure and the exterior building wall covering, carried by the outer wall, may extend linearly downward over the supporting structure and the rigid insulation.

* * * * *